US007021303B2

(12) United States Patent
Ho et al.

(10) Patent No.: US 7,021,303 B2
(45) Date of Patent: Apr. 4, 2006

(54) BARREL LOCKING APPARATUS FOR A PAINTBALL GUN

(75) Inventors: Stephen Ho, Sugarland, TX (US); Kheng Phang, Sugarland, TX (US)

(73) Assignee: Avalon Advanced Products, Inc, Houston, TX (US)

( * ) Notice: Subject to any disclaimer, the term of this patent is extended or adjusted under 35 U.S.C. 154(b) by 0 days.

(21) Appl. No.: 10/862,005

(22) Filed: Jun. 4, 2004

(65) Prior Publication Data

US 2005/0268895 A1 Dec. 8, 2005

(51) Int. Cl.
*F41B 11/00* (2006.01)

(52) U.S. Cl. ..... 124/80; 124/83

(58) Field of Classification Search ..... 124/1, 124/56, 73, 74, 80, 83; 89/30
See application file for complete search history.

(56) References Cited

U.S. PATENT DOCUMENTS 3,063,184 A * 11/1962 Sukala, Jr. ..... 42/96
4,817,322 A * 4/1989 Dietz et al. ..... 42/96
5,046,276 A * 9/1991 Morris ..... 42/70.01
5,669,172 A * 9/1997 Goral ..... 42/96

* cited by examiner

*Primary Examiner*—John A. Ricci
(74) *Attorney, Agent, or Firm*—Robert W Strozier

(57) ABSTRACT

A paintball gun or marker end cap apparatus is disclosed, where the end cap apparatus includes an internal portion having a paintball penetrating device and vent(s) for rupturing inadvertently discharged paintballs and exhausting gases and fluids, respectively, and an external portion having a locking or engaging assembly for engaging an outer portion of the paintball gun or marker with sufficient force that the assembly must to unlocked or untightened to remove.

6 Claims, 8 Drawing Sheets

BARREL LOCKING APPARATUS FOR A PAINTBALL GUN

BACKGROUND OF THE INVENTION

1. Field of the Invention

The present invention relates to a paintball gun or marker barrel locking end cap apparatus.

More particularly, the present invention relates to a paintball gun or marker barrel locking end cap apparatus, where the apparatus includes a cylindrical barrel end insert, a paintball penetrator disposed within an interior of the insert, and an outer barrel engaging and locking assemblage having retention straps attached thereto.

2. Description of the Related Art

Inadvertent firing or discharging of a paintball from a paintball gun or marker is a serious safety problem facing users, spectators and innocent bystanders. Although many barrel adaptors or condoms have been designed and introduced into the market, these devices are capable of being easily detached removing any protection that the devices afforded prior to detachment.

Thus, there is a need in the art for an improved barrel plug or condom for use with paintball guns or markers to improve safety and lessen the chance of inadvertent detachment of the device.

SUMMARY OF THE INVENTION

The present invention provides a paintball gun or marker barrel locking end cap including an internal barrel portion comprising a cylindrical barrel plug insert having an inwardly extending paintball penetrating member disposed therein and one or a plurality of vents leading from an interior of the barrel to an exterior of the end cap. The vents are designed to exhaust any gases from an inadvertent firing or discharging of the gun or marker and to exhaust any paint from a paintball after the paintball has been punctured by the penetrating member. The end cap also includes an external portion comprising an outer barrel surface engaging assembly designed to surround an outer portion of the barrel near an end of the barrel, where the engaging assembly includes an outer barrel engaging and securing or locking member. The outer barrel member of the engaging assembly is designed to engage the outer portion of the barrel with sufficient force that the end cap cannot be removed without reducing an engaging force by untightening the outer barrel member.

The present invention provides a method for preventing inadvertent paintball discharges from a paintball gun or mark including the step of inserting an internal barrel portion of a locking barrel end cap into an end of a barrel of a paintball gun or marker, where the internal barrel portion comprises a cylindrical barrel plug insert having an inwardly extending paintball penetrating member disposed therein and one or a plurality of vents leading from an interior of the barrel to an exterior of the end cap. The vents are designed to exhaust any gases from an inadvertent firing or discharging of the gun or marker and to exhaust any paint from a paintball after the paintball has been punctured by the penetrating member. After inserting the internal portion into the barrel end, an external portion is tightened about a portion of the barrel near the barrel end with sufficient engaging force that the end cap cannot be removed unless the external portion is loosened or untightened, where the external portion comprises an outer barrel surface engaging member designed to surround an outer portion of the barrel near an end of the barrel. The external portion of the barrel end cap apparatus can be integral with, affixed to or detachably affixed to the internal portion of the barrel end cap.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
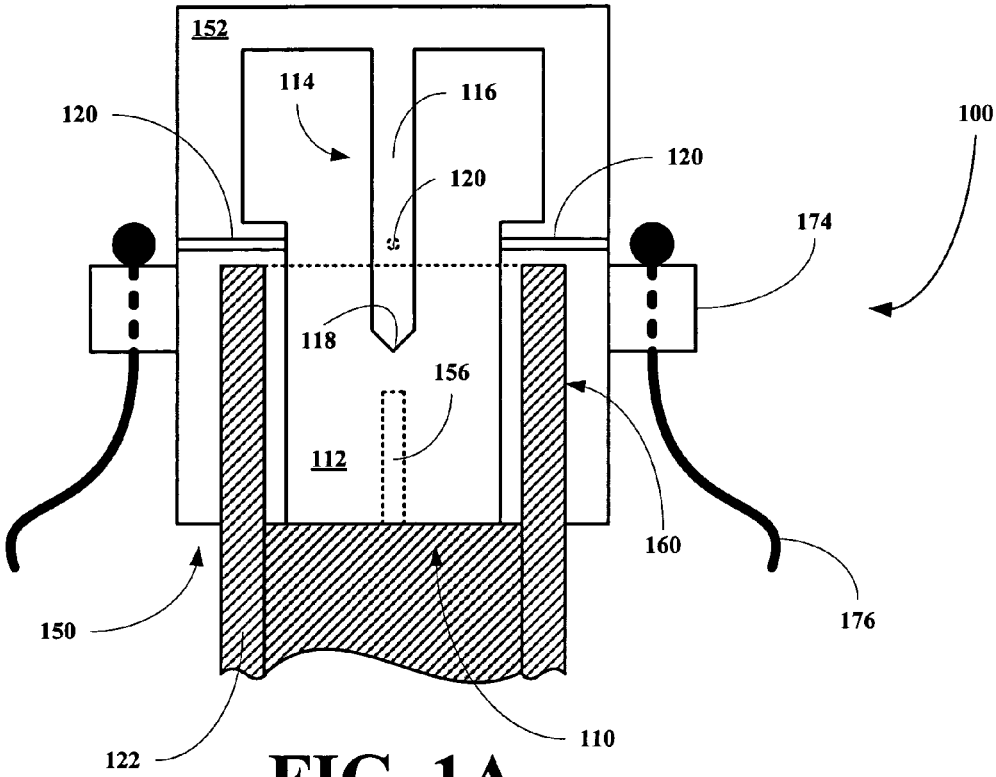
FIGS. 1A–D depict a preferred embodiment of a locking barrel end cap for a paintball gun in cross-sectional, plan and top views, respectively.
Figure 1B:
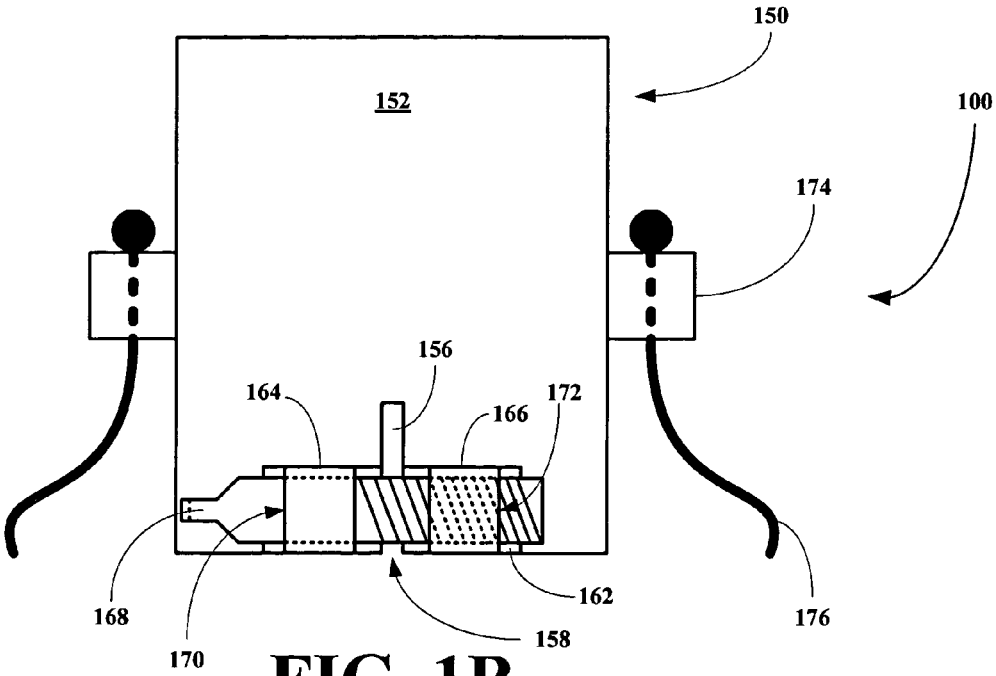

The inventors have found that a barrel end cap can be constructed that includes an internal portion having a paintball an inwardly extending penetration member and a plurality of aperture leading from the barrel interior to the exterior of the end cap. The end cap also includes an external part having a securing or locking assembly that is designed to engage an exterior surface of the barrel with sufficient force to prevent the cap from being inadvertently detaching from the barrel.

The present invention broadly relates to a paintball gun or marker locking end cap apparatus including an internal portion having a barrel insert including a paintball penetrating device extending from an interior of the insert towards a barrel end of the insert and one or a plurality of vents allowing materials to flow from an interior of the barrel to the surroundings. The penetrating device is designed to rupture any paintball inadvertently fired or discharged by the paintball gun or marker and the vent or vents are designed to exhaust any gases or paint from an inadvertent firing or discharging of the paintball gun or marker. The end cap apparatus also includes an external portion including a barrel engaging assembly, where the barrel engaging assembly is designed to engage an outer portion of the barrel near the barrel end with sufficient force so that the end cap cannot be removed without first untightening or unlocking the barrel engaging assembly.

Referring now to FIGS. 1A–D, a preferred embodiment of a paintball gun end cap apparatus, generally 100, is shown to include an internal portion 110 and an external portion 150. The internal portion 110 includes a cylindrical barrel plug insert 112 having a paintball penetrating member 114 comprising an inwardly pointing spike 116 having a pointed tip 118 and a plurality of vents 120. The penetrating member 114 is designed to rupture any paintball inadvertently fired or discharged from a paint ball gun (not shown) as it travels down a barrel 122 toward the penetrating member 114. The vents 120 are designed to exhaust any gases or fluid generated from an inadvertent firing or discharging of a paintball and rupturing of the paintball as it encounters the penetrating member 114.

The external portion 150 includes cap portion 152 and a cylindrical outer barrel engaging portion 154 including two opposing slits 156 and a tightening assembly 158 associated with each slit 156. The assembly 158 is designed to generate a sufficient engaging force against a portion 160 of the barrel 122 so that the apparatus cannot be removed without untightening the assembly 158. The tightening assembly 158 includes a base 162, a guide block 164, a threaded block 166 and a threaded wing nut 168, where the wing nut 168 (or any other threaded bolt that can be tightened using a user's finger) is inserted through an aperture 170 in the guide block 162 and into a threaded aperture 172 in the threaded block 166 so that by screwing the wing nut 168 into the threaded aperture 172, the slit 156 is narrowed or closed generating the engaging force. Additionally, the barrel 122 can include a groove (not shown) into which a tab (not shown) on the inside of the outer barrel engaging portion 154 fits to further secure the apparatus 100 to the barrel 122. The apparatus 100 also includes straps 174 and strap blocks 176 affixed to the cap portion 152, where the straps 174 are designed to prevent the end cap apparatus 100 from being lost from the gun when not in use. The straps 174 generally are tied to the gun at their other ends.

Figure 1C:
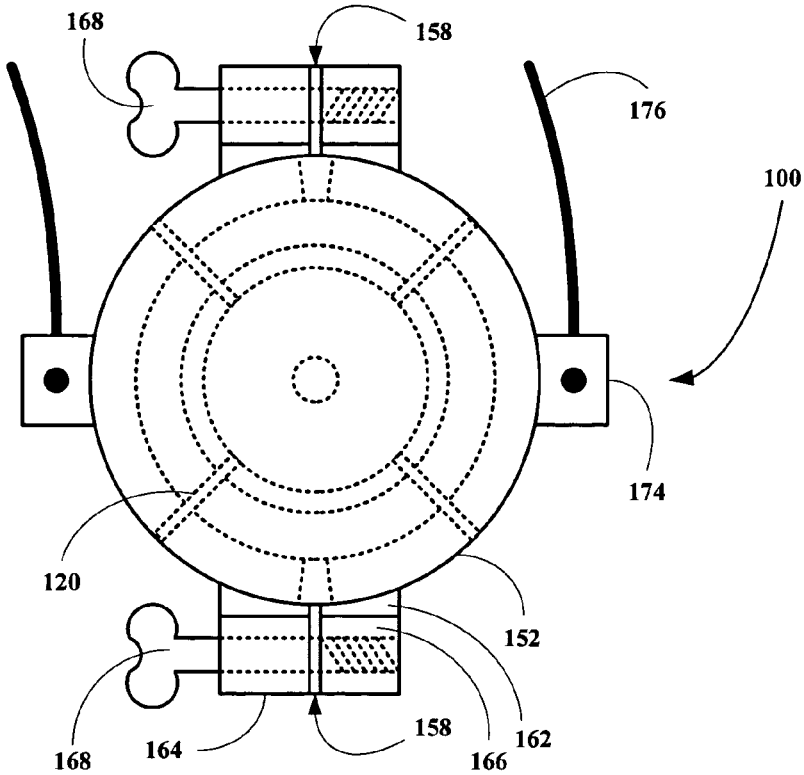
Figure 1D:
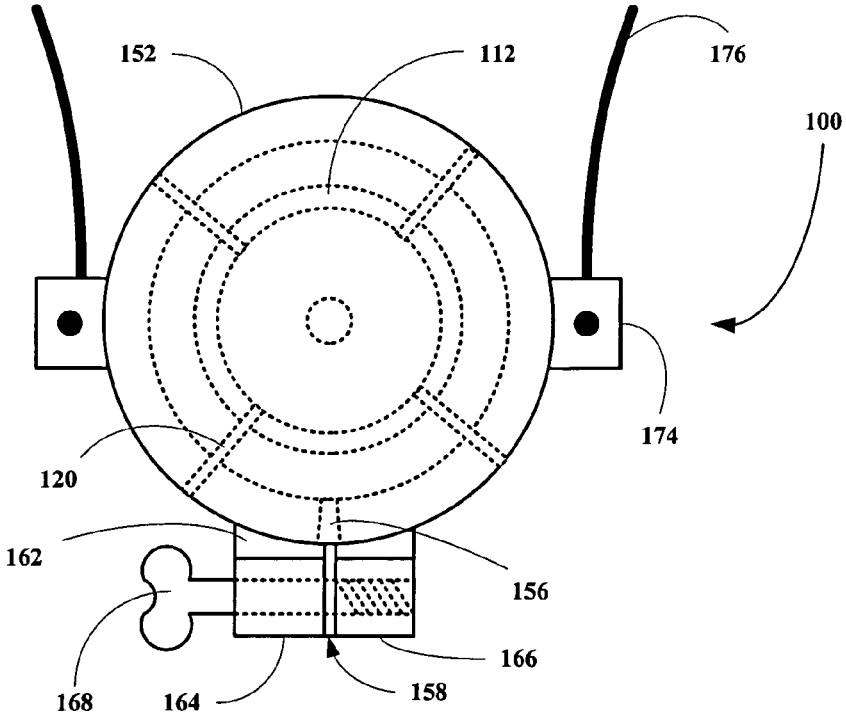

Looking at FIG. 1C, the apparatus 100 includes two opposing slits 156 having associated tightening assemblies 158, one for each slit 156. Looking at FIG. 1D, the apparatus 100 includes a single slit 156 having an associated tightening assembly 158.

Figure 2A:
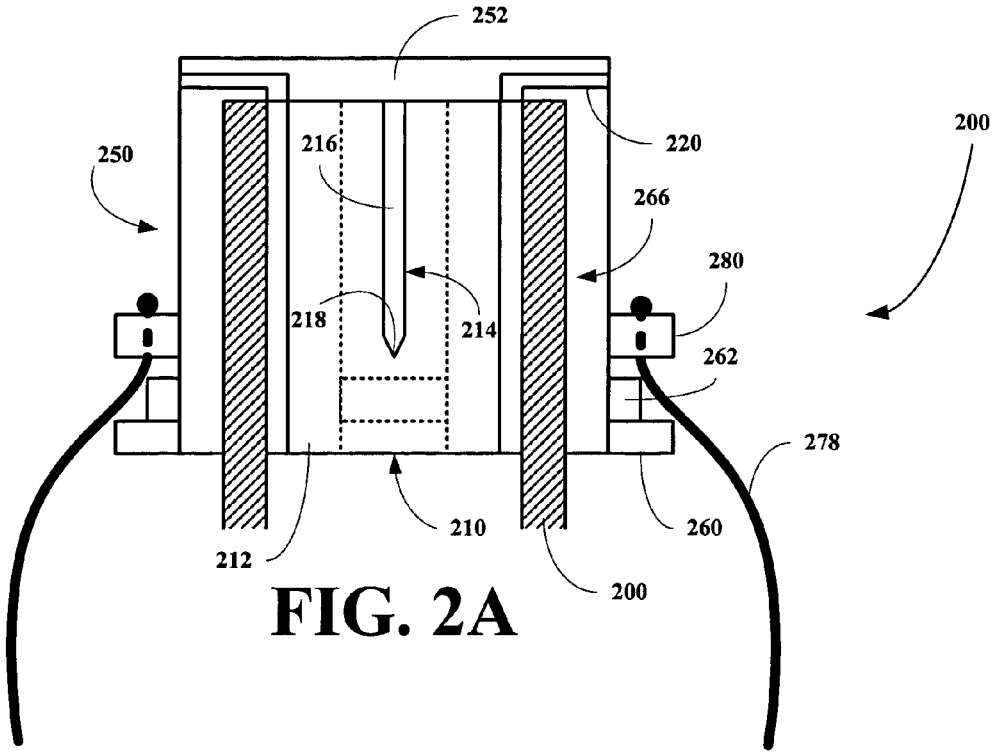
FIGS. 2A–D depict another preferred embodiment of a locking barrel end cap for a paintball gun in cross-sectional, side and top views, respectively and an expanded view of an engaging ring.
Figure 2B:
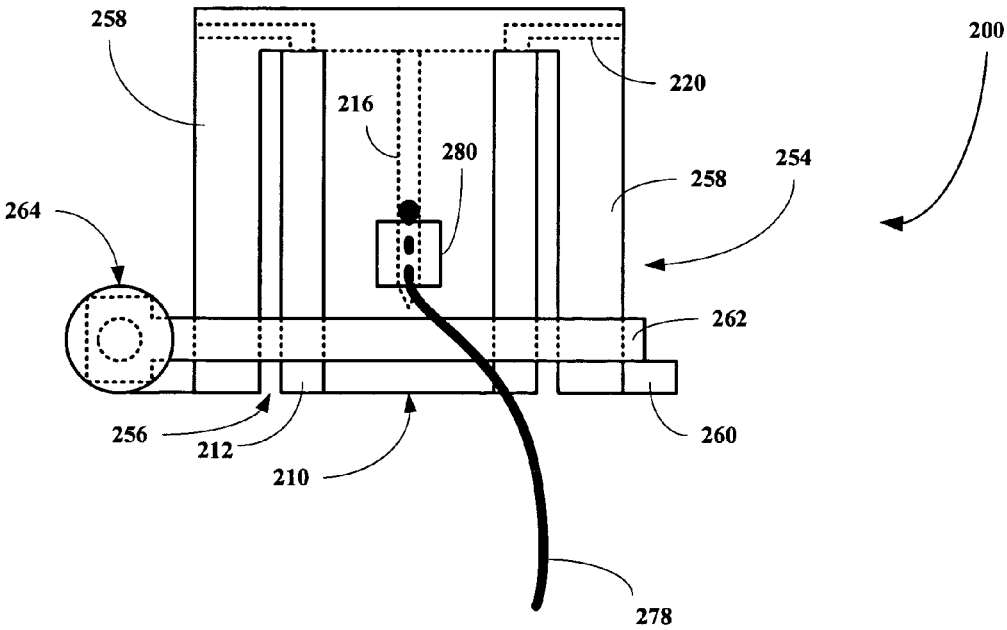
Figure 2C:
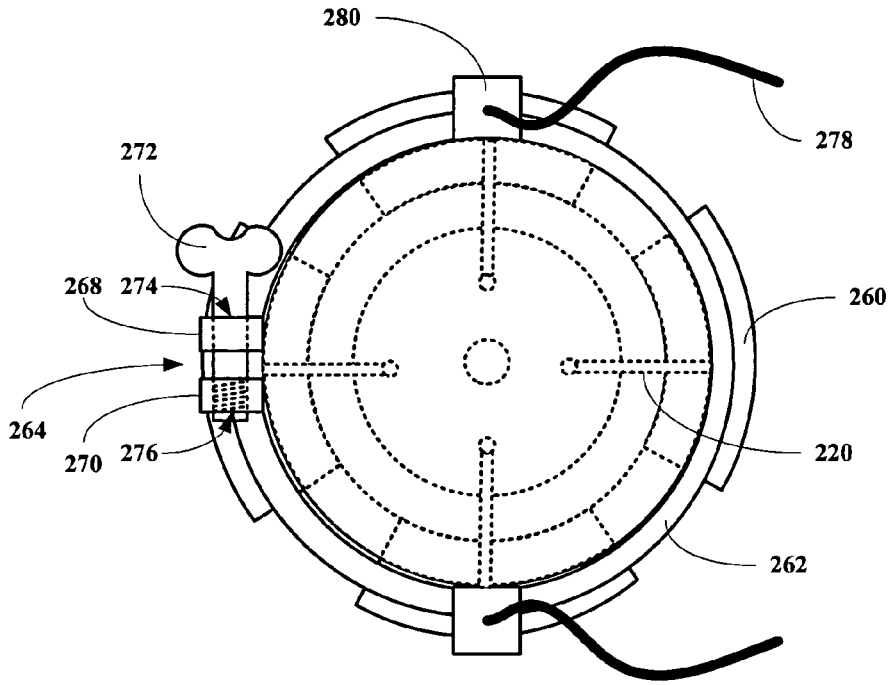

Referring now to FIGS. 2A–C, another preferred embodiment of a paintball gun end cap apparatus, generally 200, is shown to include an internal portion 210 and an external portion 250. The internal portion 210 includes a cylindrical barrel plug insert 212 having a paintball penetrating member 214 comprising an inwardly pointing spike 216 having a pointed tip 218 and a plurality of vents 220. It should be recognized that although a single penetrating member 214 is shown, a plurality of such members could also be used. The penetrating member 214 is designed to rupture any paintball inadvertently fired or discharged from a paint ball gun (not shown) as it travels down a barrel 222 toward the penetrating member 214. The vents 220 are designed to exhaust any gases or fluid generated from an inadvertent firing or discharging of a paintball and rupturing of the paintball as it encounters the penetrating member 214.

Figure 2D:
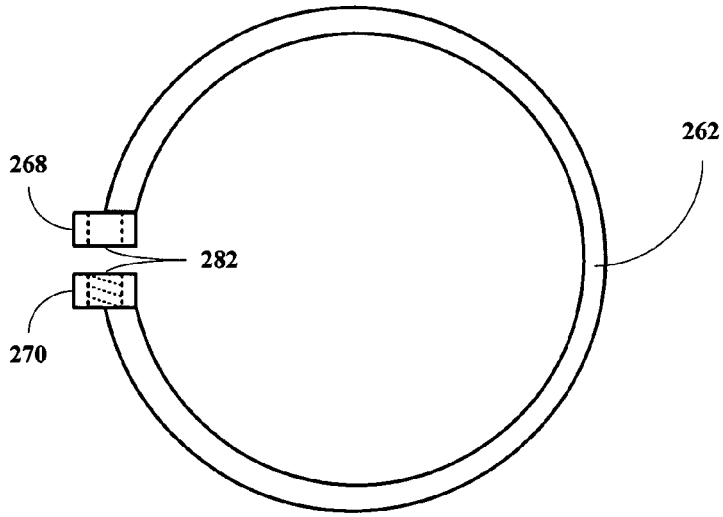

The external portion 250 includes cap portion 252 and a slotted cylindrical outer barrel engaging portion 254 including a plurality of slots 256 separating a plurality of barrel engaging members 258 having tightening ring supports 260. The engaging portion 254 also includes a tightening ring 262 having a tightening assembly 264 associated therewith supported on the ring supports 260. The assembly 264 is designed to tighten the tightening ring 262 generating a sufficient engaging force against a portion 266 of the barrel 222 so that the apparatus cannot be removed without untightening the assembly 264. The tightening assembly 264 includes a guide block 268, a threaded block 270 and a threaded wing nut 272, where the wing nut 272 (or any other threaded bolt that can be tightened using a user's finger) is inserted through an aperture 274 in the guide block 268 and into a threaded aperture 276 in the threaded block 270 so that by screwing the wing nut 272 into the threaded aperture 276, the engaging members 258 are forced towards each other closing the slots 256 generating the engaging force. Additionally, the barrel 222 can include a groove into which a tab on the inside of the outer barrel engaging portion 254 fits to further secure the apparatus 200 to the barrel 222. The apparatus 200 also includes straps 278 and strap blocks 280 affixed to the cap portion 252, where the straps 278 are designed to prevent the end cap apparatus 200 from being lost from the gun when not in use. The straps 278 generally are tied to the gun at their other ends. Looking at FIG. 2D, the tightening ring 262 is shown separated clearly showing that the guide block 268 and the threaded block 270 comprise opposing ends 282 of the tightening ring 262.

Figure 3A:
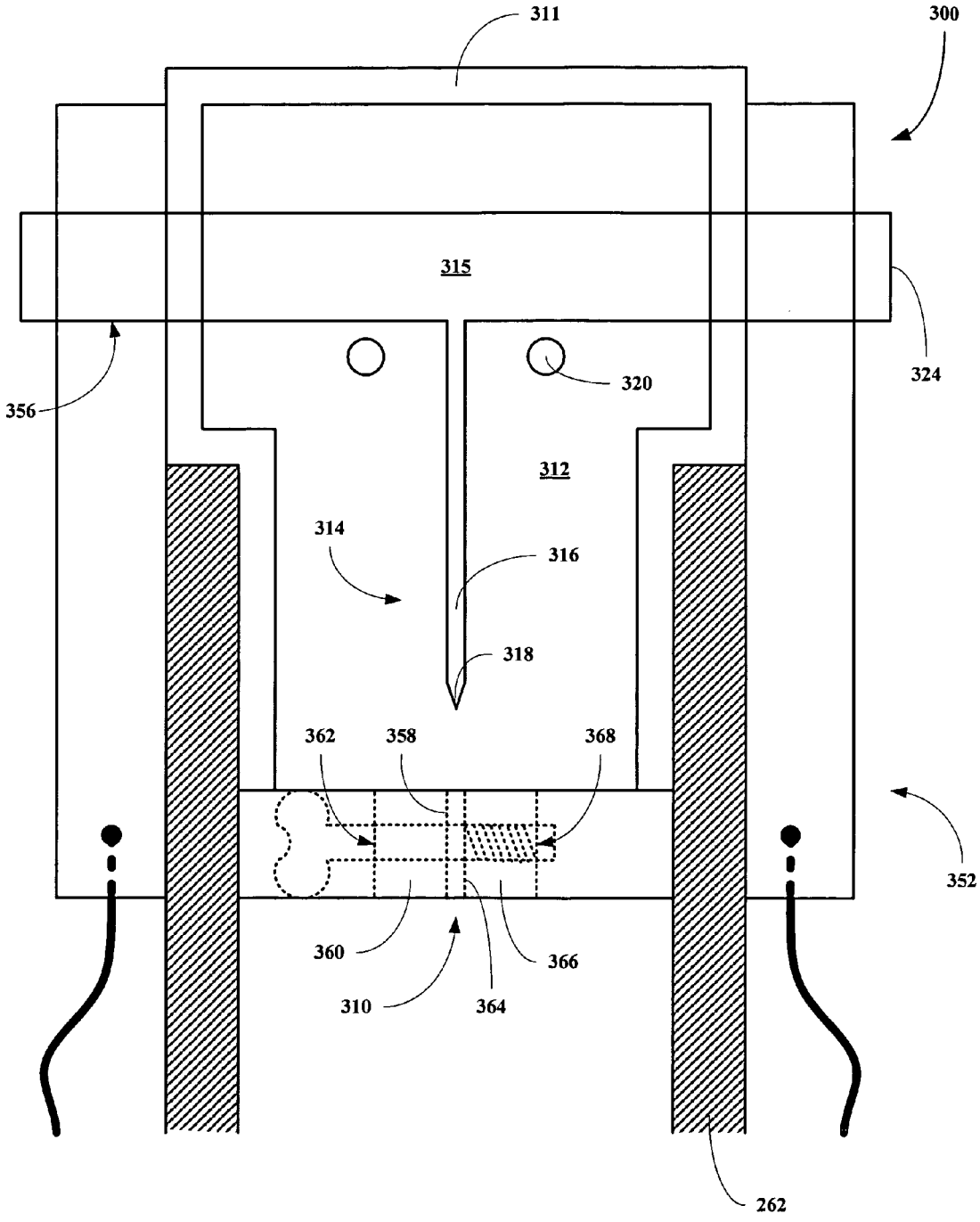
FIGS. 3A–C depict another preferred embodiment of a locking barrel end cap for a paintball gun in a cross-sectional, side and perspective views.
Figure 3B:
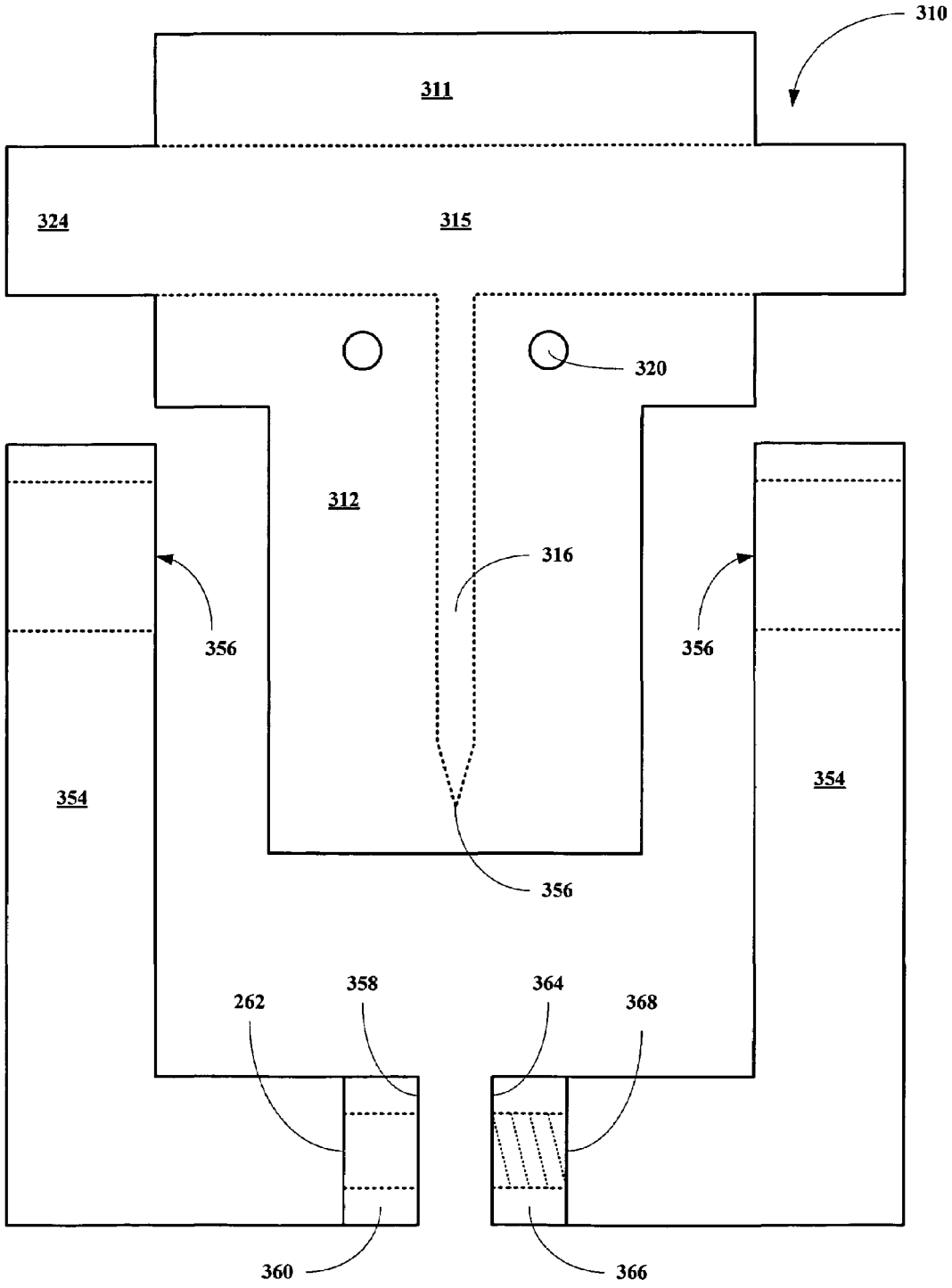
Figure 3C:
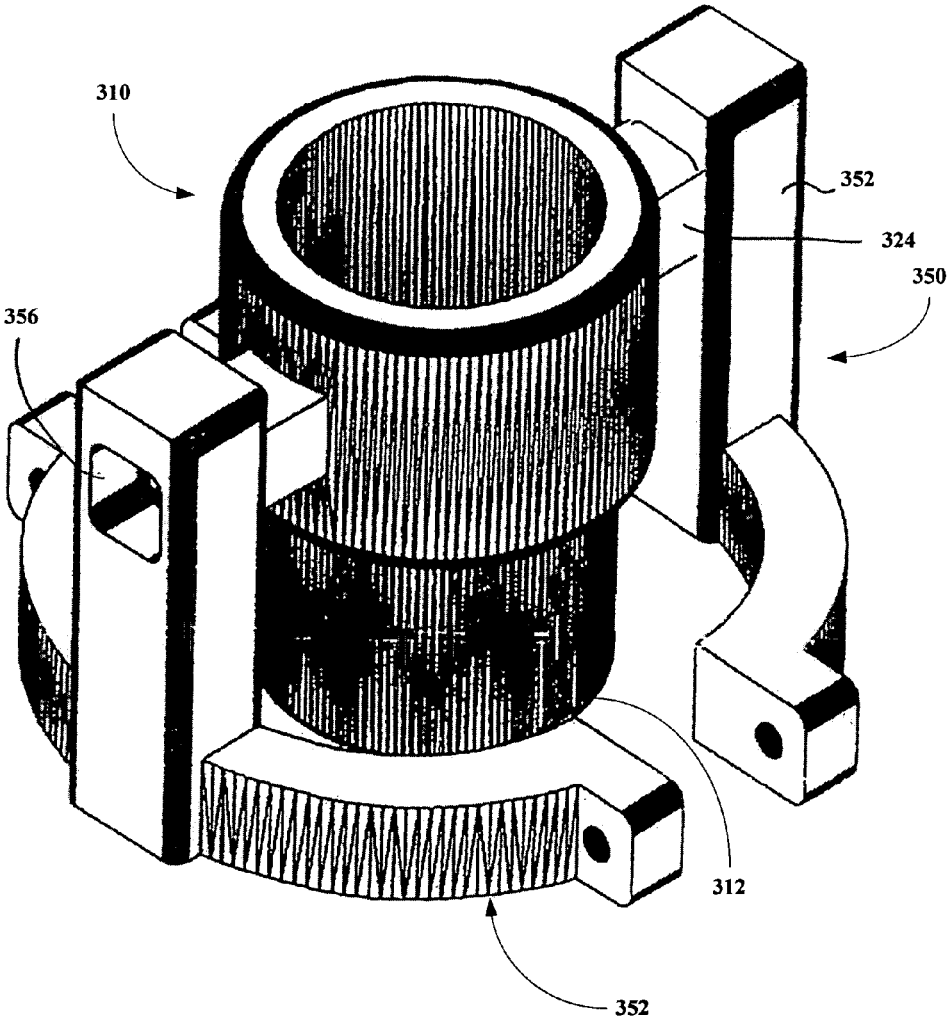

Referring now to FIGS. 3A–C, another preferred embodiment of a paintball gun end cap apparatus, generally 300, is shown to is shown to include an internal portion 310 and an external portion 350. The internal portion 310 includes a larger cylindrical cap portion 311 and a smaller cylindrical barrel insert 312 and a paintball penetrating member 314 comprising an inwardly pointing spike 316 having a pointed tip 318 and a plurality of vents 320. The penetrating member 314 extends inward from a cross-beam 315. It should be recognized that although a single penetrating member 314 is shown, a plurality of such members could also be used. The penetrating member 314 is designed to rupture any paintball inadvertently fired or discharged from a paint ball gun (not shown) as it travels down a barrel 322 toward the penetrating member 314. The vents 320 are designed to exhaust any gases or fluid generated from an inadvertent firing or discharging of a paintball and rupturing of the paintball as it encounters the penetrating member 314. The cap portion 311 includes two protrusions 324 designed to engage apertures on the external portion 350.

The external portion 350 includes two C-shaped barrel engaging members 352, each member 352 including a vertical post 354 having an aperture 356 designed to engage the protrusions 324 so that the members 352 hang from the protrusions 324. Each C-shaped barrel engaging member 352 includes a first end 358 having a guide block 360 including a guide aperture 362 therethrough extending outwardly therefrom. Each C-shaped barrel engaging member 352 also includes a second end 364 having a threaded block 366 including a threaded aperture 368 therethrough extending outwardly therefrom, where the threaded aperture 368 is designed to engage a wing nut (not shown) or other hand tightenable threaded member.

Figure 4:
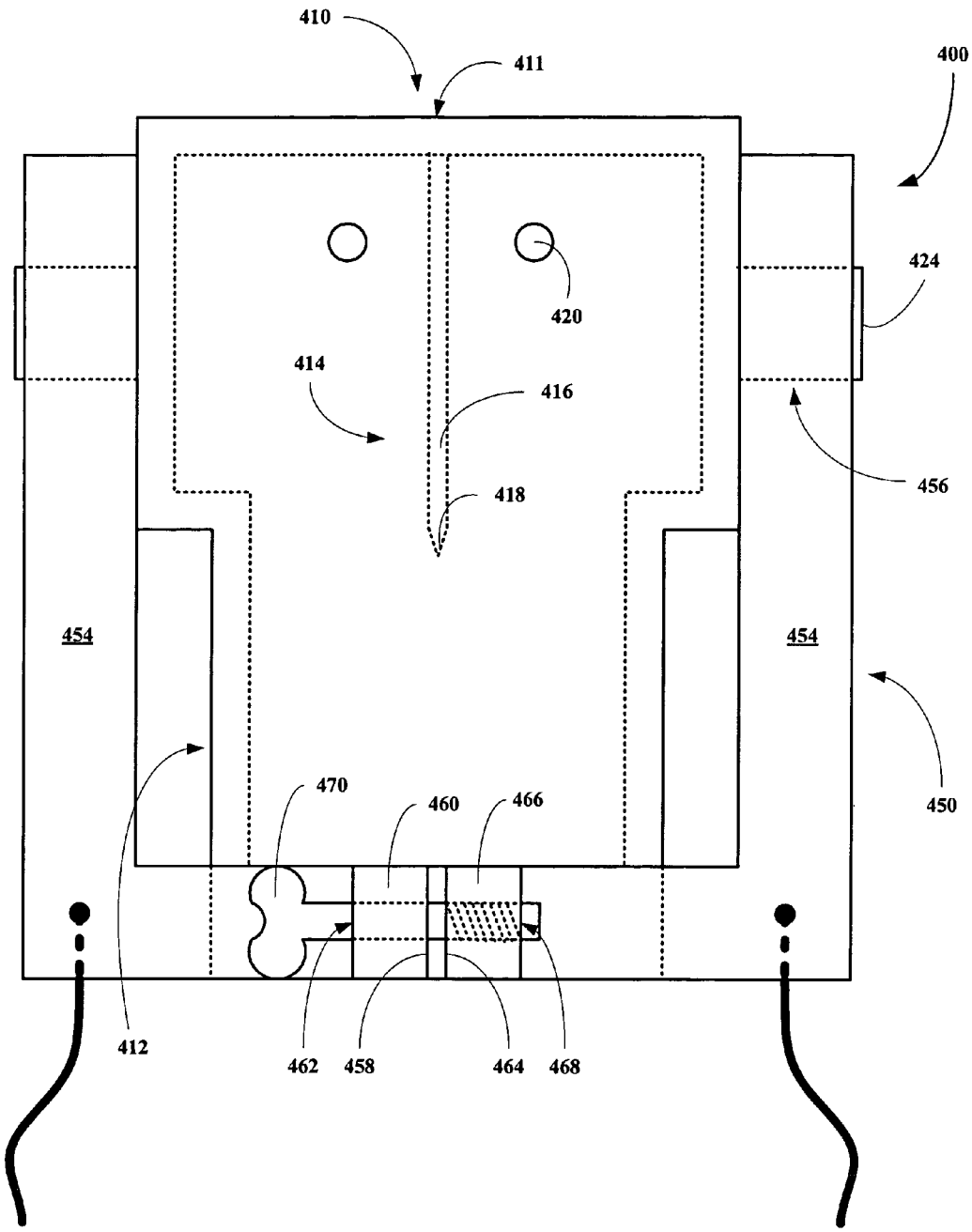
FIG. 4 depicts a side view of another preferred embodiment of a locking barrel end cap for a paintball gun.

Referring now to FIG. 4, another preferred embodiment of a paintball gun end cap apparatus, generally 400, is shown to is shown to is shown to include an internal portion 410 and an external portion 450. The internal portion 410 includes a larger cylindrical cap portion 411 and a smaller cylindrical barrel insert 412 and a paintball penetrating member 414 comprising an inwardly pointing spike 416 having a pointed tip 418 and further comprising a plurality of vents 420. The penetrating member 414 extends inward from a top 413 of the larger cylindrical cap portion 411. It should be recognized that although a single penetrating member 414 is shown, a plurality of such members could also be used. The penetrating member 414 is designed to rupture any paintball inadvertently fired or discharged from a paint ball gun (not shown) as it travels down a barrel (not shown) toward the penetrating member 414. The vents 420 are designed to exhaust any gases or fluid generated from an inadvertent firing or discharging of a paintball and rupturing of the paintball as it encounters the penetrating member 414. The cap portion 411 includes two protrusions 424 designed to engage apertures on the external portion 450.

The external portion 450 includes two C-shaped barrel engaging members 452, each member 452 including a vertical post 454 having an aperture 456 designed to engage the protrusions 424 so that the members 452 hang from the protrusions 424. Each C-shaped barrel engaging member 452 includes a first end 458 having a guide block 460 including a guide aperture 462 therethrough extending outwardly therefrom. Each C-shaped barrel engaging member 452 also includes a second end 464 having a threaded block 466 including a threaded aperture 468 therethrough extending outwardly therefrom, where the threaded aperture 468 is designed to engage a wing nut 470 or other hand tightenable threaded member.

Although several locking assemblies have been shown for securing the end cap apparatuses of this invention to an end of a paintball barrel, other locking assemblies can also be used and are considered equivalents of the threaded connectors shown above. For example, the locking assembly could comprise a clamping device with a release such as a vice-grip, the C-shaped members could have clips or pins, or the ring could be a slotted band with a tightening screw. These and other tightening assemblies can be used equivalently in the barrel end caps of this invention.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A locking paintball barrel end cap apparatus comprising:

an internal portion including:

a cylindrical barrel insert having a paintball penetrating member extending into an interior of the insert, and at least one vent leading from the interior of the insert to an outer surface of the insert, and an external portion including:

a barrel engaging assembly, and a tightening assembly, where the barrel insert is adapted to be inserted into the barrel of a paintball gun, where the penetrating member is adapted to rupture an inadvertently fired paintball, where the vents are adapted to exhaust any gases or fluids associated with the inadvertent fired paintball, where the barrel engaging assembly is adapted to engage an outer surface of the barrel and where the tightening assembly is adapted to impart a barrel engaging force, which is sufficient so that the apparatus is removed only after the tightening assembly is loosened.

2. The apparatus of claim 1, wherein the barrel engaging assembly comprises an outer cylinder having a vertical slit therein and surrounds a portion of the end of the barrel and wherein the tightening assembly includes a guide block on one side of the slit and a threaded block on an other side of the slit and a wing nut designed to draw the outer cylinder tight against barrel portion with the sufficient force.

3. The apparatus of claim 1, wherein the barrel engaging assembly comprises an outer cylinder having two vertical slits therein and surrounds a portion of the end of the barrel and wherein the tightening assembly includes guide block on one side of each of the slits and threaded block on an other side of each of the slits and a wing nuts designed to draw the outer cylinder tight against barrel portion with the sufficient force.

4. The apparatus of claim 1, wherein the barrel engaging assembly comprises:

a plurality of downward extending barrel engaging members separated by a plurality of slots, where each barrel engaging member includes a ring support at its distal end, and a clamping ring including a first end having a guide block extending outward therefrom, and a second end having a threaded block extending outward therefrom, and a threaded, finger tightenable member adapted to be inserted through the guide block and engage the threaded block to tighten the barrel engaging members against a portion of the end of the barrel and where the ring is supported by the ring supports on the barrel engaging members.

5. The apparatus of claim 1, wherein the insert includes a larger diameter cap portion having two protrusions extending outward therefrom on opposite sides of the cap portion and wherein the barrel engaging assembly comprises two C-shaped barrel engaging members, each member including a vertical post having an aperture therein for fitting onto one of the protrusions, and the C-shaped barrel engaging members include between them two ends having an outwardly extending guide block and two ends having an outwardly extending threaded block, where a guide block on one C-shaped member is designed to abut a threaded block on the other C-shaped member so that two finger tightenable, threaded members can tighten the C-shaped members against a portion of the end of the barrel.

6. A locking paintball barrel end cap apparatus comprising: an internal portion including:

a barrel insert having a paintball penetrating member extending into an interior of the insert, a cap having a diameter greater than a diameter of the insert, at least one vent leading from the interior of the insert to an outer surface of the insert, and two protrusions extending outward and an external portion including:

two C-shaped barrel engaging members, each C-shaped barrel engaging member includes a vertical post having an aperture therethrough for engaging one of the protrusions, a first end having a guide block including a guide aperture, a second end having a threaded block including a threaded aperture, and two finger tightenable threaded members for tightening the C-shaped barrel engaging members against the barrel, where the barrel insert is adapted to be inserted into the barrel of a paintball gun, where the penetrating member is adapted to rupture an inadvertently fired paintball, where the vents are adapted to exhaust any gases or fluids associated with the inadvertent fired paintball, where the at least one barrel engaging member is adapted to engage an outer surface of the barrel and where the tightenable threaded members are adapted to impart a barrel engaging force, which is sufficient so that the apparatus is removed only after the tightening assembly is loosened.

* * * * *